US007792454B2

(12) United States Patent
Nishisaka et al.

(10) Patent No.: US 7,792,454 B2
(45) Date of Patent: Sep. 7, 2010

(54) IMAGE FORMING APPARATUS

(75) Inventors: Yusuke Nishisaka, Tokyo (JP); Hiroshi Morimoto, Tokyo (JP)

(73) Assignee: Konica Minolta Business Technologies, Inc. (JP)

( * ) Notice: Subject to any disclaimer, the term of this patent is extended or adjusted under 35 U.S.C. 154(b) by 87 days.

(21) Appl. No.: 12/326,608

(22) Filed: Dec. 2, 2008

(65) Prior Publication Data

US 2009/0148177 A1 Jun. 11, 2009

(30) Foreign Application Priority Data

Dec. 5, 2007 (JP) ..... 2007-314511

(51) Int. Cl.
*G03G 21/00* (2006.01)

(52) U.S. Cl. ..... 399/71; 399/123; 399/343; 399/357

(58) Field of Classification Search ..... 399/71, 399/107, 123, 343, 350, 351, 357–360; 15/256.51, 15/256.52
See application file for complete search history.

(56) References Cited

U.S. PATENT DOCUMENTS 6,480,695 B2 * 11/2002 Endo et al. ..... 399/349
7,302,203 B2 * 11/2007 Morimoto et al. ..... 399/101
7,536,147 B2 * 5/2009 Kageyama ..... 399/350

FOREIGN PATENT DOCUMENTS

JP 3-242677 A 10/1991
JP 2003-36011 A 2/2003
JP 2005-249915 9/2005

OTHER PUBLICATIONS

Office Action for JP 2007-314511 dated Oct. 15, 2009 with English translation.

* cited by examiner

*Primary Examiner*—Hoan Tran
(74) *Attorney, Agent, or Firm*—Cantor Colburn LLP

(57) ABSTRACT

An image forming apparatus provided with a cleaning device including a cleaning blade in contact with an image carrier with contact pressure for removing the toner remaining on the image carrier; a toner guide roller which is located upstream of the cleaning blade in the rotating direction of the image carrier and which rotates in contact with the image carrier; a toner ejection regulating member in contact with the toner guide roller to eject the remaining toner appropriately; and a space formed by the enclosure of the image carrier, cleaning blade, toner guide roller and toner ejection regulating member for the purpose of storing the remaining toner; and this image forming apparatus further includes a control device that controls the cleaning device so as to change the peripheral speed ratio of the toner guide roller with respect to the image carrier, in response to change in the system speed.

3 Claims, 3 Drawing Sheets

IMAGE FORMING APPARATUS

This application is based on Japanese Patent Application No. 2007-314511 filed on Dec. 5, 2007 in Japanese Patent Office, the entire content of which is hereby incorporated by reference.

BACKGROUND OF THE INVENTION

The present invention relates to image forming apparatuses using the electro-photographic method, such as copiers, printers, and facsimile machines, and, in particular, relates to cleaning devices for removing the toner remaining on the image carrier.

An image forming apparatus is known which forms a toner image on a photoreceptor drum provided with, around it, various devices for charging, exposure, and development and which has a configuration for transferring the toner image onto a recording sheet, or a configuration for making a primary transfer of the toner images formed on plural photoreceptor drums onto an intermediate image transfer belt and then making a secondary transfer of the toner image on the intermediate image transfer belt onto a recording sheet. In this type of image forming apparatus, a cleaning apparatus for removing the toner remaining on the photoreceptor drum or on the intermediate image transfer belt without being transferred (hereinafter, they are called image carriers) by causing a blade made of a material such as urethane rubber to press against the image carrier in the direction counter to the direction of movement of the image carrier.

In this type of blade cleaning apparatus, since it is necessary to cause the cleaning blade to press against the image carrier with a force of a prescribed value to scrape off the remaining toner surely, friction is generated between the cleaning blade and the image carrier and this friction causes problems such as bending of the cleaning blade, damage to the cleaning blade edge, toner filming, and pitch variations of the image caused by changes in the image carrier driving force due to increased friction force.

When the remaining toner is removed from the image carrier by a cleaning blade, the remaining toner can be removed by the edge of the cleaning blade, but part of the toner remains on the edge. Abrasive particles contained in the toner become a lubricant and a small quantity of these particles enter the space between the edge and image carrier, whereby the friction coefficient between the cleaning blade and image carrier is reduced. This arrangement allows the remaining toner to be removed on a continuous basis without causing the blade to be curled up.

An invention has been proposed to make effective use of the aforementioned function, whereby the aforementioned problems are solved. To be more specific, paying attention to the remaining toner having been removed by the cleaning blade, this invention keeps the toner temporarily stored in a space provided in the vicinity of the cleaning blade, without recovering the remaining toner immediately, whereby the toner is always present on the edge of the cleaning blade (see Japanese Unexamined Patent Application Publication No. 2005-249915).

This arrangement provides the cleaning blade with lubricating ability without being affected by the printing span or printing ratio, and solves the problems related to curling of the cleaning blade, damage on the edge of the cleaning blade, toner filming or pitch irregularity of the image.

Referring to FIG. 1, the following describes the cleaning device disclosed in the Japanese Unexamined Patent Application Publication No. 2005-249915.

The reference numeral 601 denotes a casing, on which various members constituting the cleaning device are mounted.

The reference numeral 602 denotes a cleaning blade made of an elastic body such as urethane rubber. This blade is fastened onto the blade holder 603 by an adhesive or the like.

The blade holder 603 is rotatably supported by a supporting shaft 604 mounted on the casing 601.

The reference numeral 605 indicates a tension spring. It supplies bias in such a way that the blade holder 603 rotates in the counterclockwise direction. While the edge of the cleaning blade 602 faces in the direction (in the counter direction) against the rotational direction of the intermediate image transfer belt 70, pressure contact of the edge is applied to the intermediate image transfer belt 70 backed up by a backup roller 75 at the pressure contact position C.

The reference numeral 608 is a toner guide roller made of sponge. This roller contacts the intermediate image transfer belt 70 upstream of the pressure contact position C in the rotating direction of the intermediate image transfer belt 70. Further, at the position in contact with the intermediate image transfer belt 70, the toner guide roller 608 rotates to move in the same direction as the intermediate image transfer belt 70.

The reference numeral 609 is a toner ejection regulating member made of a PET sheet. One end thereof contacts the toner guide roller 608 at the position opposite to the contact position between the toner guide roller 608 and intermediate image transfer belt 70, and the other end is fixed on the holding member 610 mounted above the toner guide roller 608 by means of double-faced adhesive tape or the like.

The holding member 610 is fixed on the projection 611 of the casing 601 by means of screws.

The aforementioned structure forms a space S enclosed by an intermediate image transfer belt 70, cleaning blade 602, toner guide roller 608, and toner ejection regulating member 609.

The reference numeral 612 is a recovery screw provided on the bottom of the casing 601. The remaining toner stored on the bottom of the casing 601 is fed in the direction perpendicular to the sheet surface of the drawing, and is ejected out of the casing 601.

The reference numeral 613 is a toner receiving sheet made of PET (polyethylene terephthalate). The one end thereof is fixed to the bottom of the casing 601, and the other end contacts the intermediate image transfer belt 70 to ensure that the toner remaining inside the casing 601 does not fall down.

The operation of a cleaning device 60 will be described below.

After the toner image on the intermediate image transfer belt 70 has been subjected to secondary transfer onto the recording sheet, the toner remaining on the intermediate image transfer belt 70 is scraped off by the cleaning blade 602, and is stored in the space S. When the amount of toner stored in the space S has exceeded a predetermined level, toner is ejected from the contact position between the toner ejection regulating member 609 and toner guide roller 608, so that the amount of the remaining toner stored therein is kept constant. In other words, if there is an increase in the amount of the remaining toner stored in the space S, the function like that of a pressure regulating valve is implemented because the toner ejection regulating member 609 is elastic, whereby a predetermined amount of the remaining toner is kept in the space S.

Thus, the upper level of the remaining toner stored is always kept above the pressure contact position C. This arrangement ensures the remaining toner as a lubricant to be supplied to the edge of the cleaning blade 602, despite the continuous image formation of a lower printing ratio.

Further, despite continued image formation of the recording sheets having a smaller width, toner is made to expand across the recording sheet by the rotation of the toner guide roller 608 and a slight vibration of the apparatus, since the remaining toner is characterized by high fluidity. Thus, the toner is stored uniformly in the space S. This arrangement allows the toner to spread along the entire length of the cleaning blade, as viewed across the recording sheet width.

In an image forming apparatus provided with the aforementioned cleaning device disclosed in the Japanese Unexamined Patent Application Publication No. 2005-249915, the system speed may be changed. For example, the system speed is set at a lower rate when thick paper is to be fixed or when glossiness is increased on a recording sheet.

In this case, the peripheral speed of the intermediate image transfer belt 70 changes. At the same time, when the peripheral speed of the toner guide roller 608 changes, there will be a change in the amount of the remaining toner ejected from the space S, and this causes a change in the stored amount. If there is a shortage in the amount of the remaining toner stored in the space S, the edge of the cleaning blade 602 will be damaged or filming will occur to the intermediate image transfer belt 70. Further, an excessive amount of the remaining toner stored will cause toner packing to occur inside the space S, or allows the remaining toner to slip through the edge of the cleaning blade 602.

In view of the problems described above, it is an object of the present invention to adequately set the peripheral speed ratio of the toner guide roller with respect to the image carrier in conformity to the speed change of the system, and to keep the amount of the remaining toner stored in the space at a constant level, thereby prolonging the service life of the cleaning blade.

SUMMARY

The aforementioned objects of the present invention can be achieved by the following invention:

An image forming apparatus provided with a cleaning device including:

a cleaning blade in contact with an image carrier with contact pressure for removing the toner remaining on the image carrier;

a toner guide roller which is located upstream of the cleaning blade in the rotating direction of the image carrier and which rotates in contact with the image carrier;

a toner ejection regulating member in contact with the toner guide roller to eject the remaining toner appropriately; and a space formed by the enclosure of the image carrier, cleaning blade, toner guide roller and toner ejection regulating member for the purpose of storing the remaining toner;

this image forming apparatus further characterized by including a control device that provides control in such a way as to change the peripheral speed ratio of the toner guide roller with respect to the image carrier, in response to a change in the system speed.

DETAILED DESCRIPTION OF THE PREFERRED EMBODIMENT

An example of embodiment relating to the present invention will be described below referring to FIG. 2.

Figure 2:
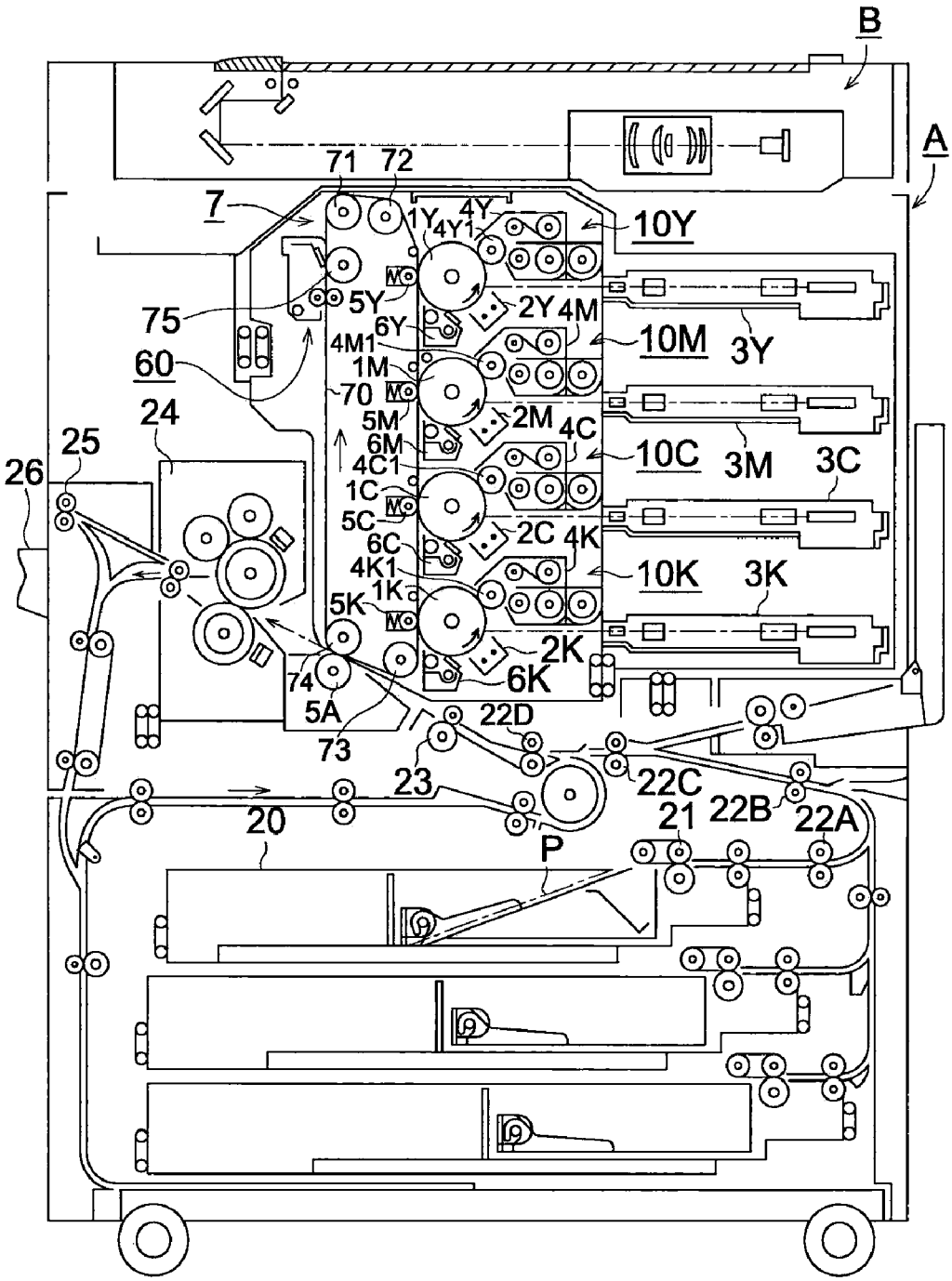
FIG. 2 is a schematic configuration diagram representing an image forming apparatus.

FIG. 2 shows a schematic structural diagram of an image forming apparatus.

The image forming apparatus is of the type called tandem type color image forming apparatus and comprises plural sets of image forming sections 10Y, 10M, 10C, and 10K, an endless belt-shaped intermediate image transfer body unit 7, a sheet transport device (no symbols assigned), and a fixing device 24. The document image reading apparatus B is placed on top of the body of the image forming apparatus A.

The image forming section 10Y that forms images of yellow color comprises the photoreceptor 1Y which is the first image carrier, the charging device 2Y, the exposure device 3Y, the developing device 4Y, the primary transfer roller 5Y which is the primary transfer device, and the cleaning device 6Y, that are placed on the periphery of said photoreceptor 1Y.

The image forming section 10M that forms images of magenta color comprises the photoreceptor 1M which is the first image carrier, the charging device 2M, the exposure device 3M, the developing device 4M, the primary transfer roller 5M which is the primary transfer device, and the cleaning device 6M, that are placed on the periphery of said photoreceptor 1M.

The image forming section 10C that forms images of cyan color comprises the photoreceptor 1C which is the first image carrier, the charging device 2C, the exposure device 3C, the developing device 4C, the primary transfer roller 5C which is the primary transfer device, and the cleaning device 6C, that are placed on the periphery of said photoreceptor 1C.

The image forming section 10K that forms images of black color comprises the photoreceptor 1K which is the first image carrier, the charging device 2K, the exposure device 3K, the developing device 4K, the primary transfer roller 5K which is the primary transfer device, and the cleaning device 6K, that are placed on the periphery of said photoreceptor 1K.

The developing device 4Y, 4M, 4C, and 4K respectively contain dual component toner (single component toner can also be used) made of toners of the colors yellow (Y), magenta (M), cyan (C), or black (K) that have been charged with electricity of the same polarity as the charging polarity of the photoreceptors 1Y, 1M, 1C, and 1K, and are provided with developing rollers 4Y1, 4M1, 4C1, and 4K1 which are toner carriers that have a cylindrical shape with, for example, a thickness of 0.5 to 1 mm and external diameter of 15 to 25 mm, and that are made of non-magnetic stainless steel or aluminum.

The developing rollers 4Y1, 4M1, 4C1, and 4K1 are maintained at a specific spacing, for example, 100 to 1000 micrometers, from the respective photoreceptors 1Y, 1M, 1C, and 1K in a non-contacting manner by projecting rollers (not shown in the figure) and are made to rotate in the direction following the rotation of the photoreceptors 1Y, 1M, 1C, and 1K.

During development, a non-contacting reversal development is carried out on the electrostatic latent image of the photoreceptors 1Y, 1M, 1C, and 1K by applying a development bias voltage that is either a DC voltage or an AC voltage superimposed on a DC voltage to the developing rollers 4Y1, 4M1, 4C1, and 4K1 with the same polarity as that of the toners.

In general, a so-called external additive would have been added to the toners with the purpose of improving the flowability and the cleaning characteristics, and among these, the external additives that are related to the present invention are metal salt of higher fatty acid such as salt of stearates of zinc, aluminum, copper, magnesium, calcium, etc., salt of oleates of zinc, manganese, iron, copper, magnesium, etc., salt of palmitates of zinc, copper, magnesium, calcium, etc., salt of linoleates of zinc, calcium, etc., salt of ricinoleates of zinc, calcium, etc.

The percentage of addition of these external additives is about 0.01% to 10% by weight relative to the toner.

The intermediate image transfer body unit 7 comprises plural rollers 71, 72, 73, 74, and 75, and the intermediate image transfer belt 70 that is semi-conductive in nature and has the shape of an endless belt.

Figure 1:
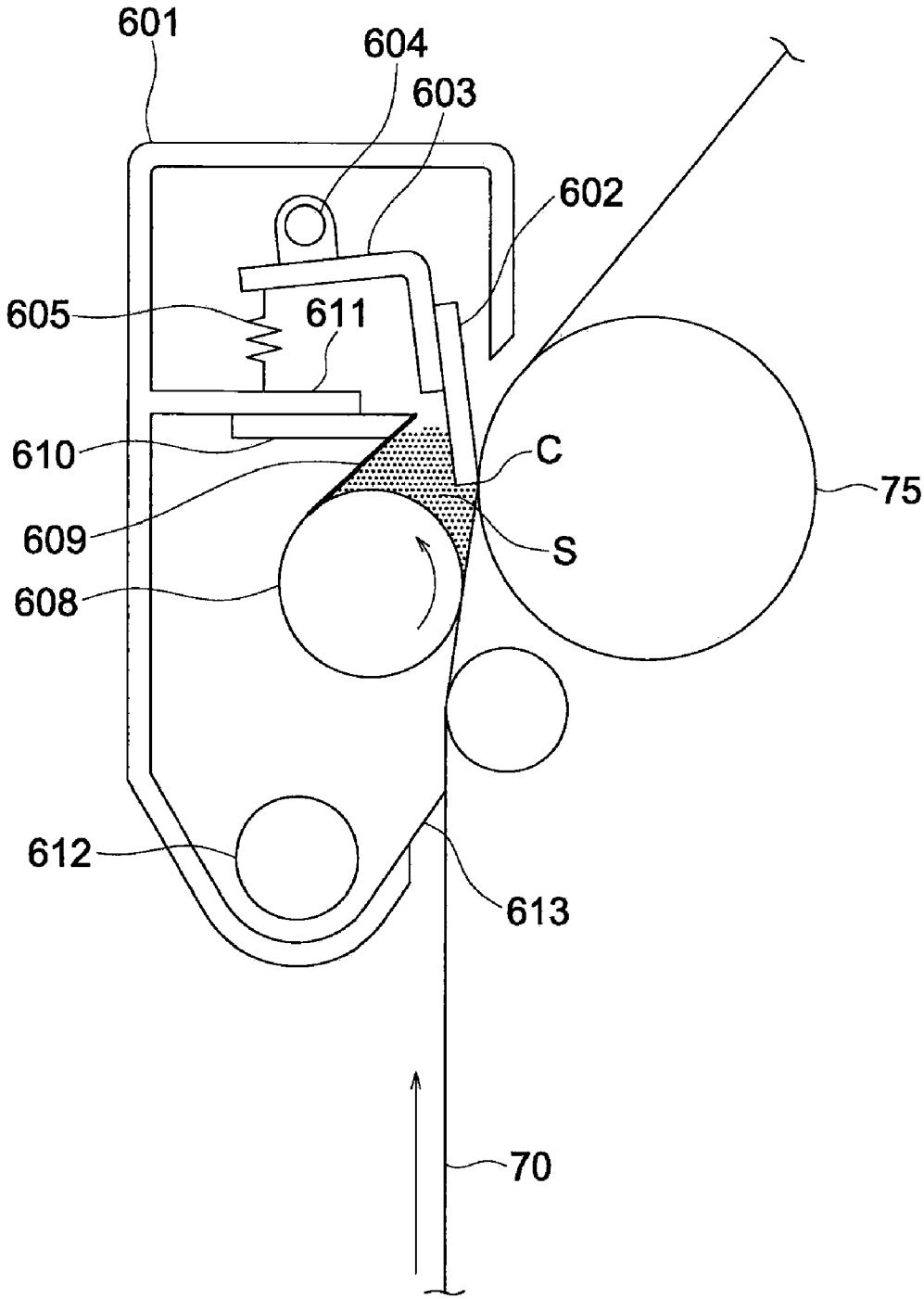
FIG. 1 is a cross sectional view of a cleaning device.

The intermediate image transfer belt 70 is supported with tension due to contact with the peripheries of the drive roller 73 that is coupled to the drive motor (not shown in the figure), the supporting rollers 71 and 72, the secondary transfer backup roller 74, and the backup roller 75, and the direction of rotation of the intermediate image transfer belt 70 is arranged to be clockwise in FIG. 1.

The primary transfer rollers 5Y, 5M, 5C, and 5K for each color are provided opposite to the photoreceptors 1Y, 1M, 1C, and 1K via the intermediate image transfer belt 70.

By applying a DC voltage with a polarity opposite to that of the polarity of the charge on the toner to the primary transfer rollers 5Y, 5M, 5C, and 5K thereby forming an image transfer electric field in the transfer region, the toner images of different colors formed on the photoreceptors 1Y, 1M, 1C, and 1K are transferred as a primary image transfer onto the intermediate image transfer belt 70.

The secondary image transfer roller 5A is provided opposite to the secondary image transfer backup roller 74 via the intermediate image transfer belt 70.

By applying a DC voltage with a polarity opposite to that of the polarity of the charge on the toner to the secondary image transfer roller 5A thereby forming an image transfer electric field in the transfer region, the superimposed toner images formed on the intermediate image transfer belt 70 are transferred as a secondary image transfer onto the surface of a recording sheet (a recording material).

The recording sheet P is supplied from the sheet feeding cassette 20 by the sheet feeding device 21, passes through plural intermediate rollers 22A, 22B, 22C, 22D and the registration roller 23, and is transported to the secondary image transfer position where the color image is transferred onto it in a single operation.

Further, when changing the size of the recording sheet P, the configuration is such that the length along the direction at right angles to the direction of transportation (the sheet width) is changed taking the center of the intermediate image transfer belt 70 as the positional reference.

The recording sheet P after the color image has been transferred onto it is subjected to fixing operation by the fixing device 24 and is placed on the ejected sheet tray 26 after being fed between the sheet ejection rollers 25.

A cleaning device 60 that removes the toner remaining on the intermediate image transfer belt 70 is provided on the downstream side of the position of secondary image transfer in the direction of rotation of the intermediate image transfer belt 70.

Further, the cleaning device 60 is identical with the cleaning device shown in FIG. 1.

Here, description will be given about the materials of the intermediate image transfer belt and the image transfer roller in the embodiment of the present invention.

The intermediate image transfer belt 70 is an endless belt with a volume resistivity of $10^6$-$10^{12}\Omega\cdot$cm, and usually the material used for it is, for example, a resin material such as polycarbonate (PC), polyimide (PI), polyamideimide (PAI), polyvinylidenefluoride (PVDF), Ethylene-tetrafluoroethylene Copolymer (ETFE), or rubber materials such as EPDM, NBR, CR, polyurethane, etc., in which conductive filler such as carbon, etc., is dispersed or which contain ionic conductive materials, and the thickness of this belt should desirably be set at about 50 to 200 micrometers in the case of resin materials and at about 300 to 700 micrometers in the case of rubber materials.

The primary image transfer rollers 5Y, 5M, 5C, and 5K are formed, for example, by coating the peripheral surface of a conductive metal core (not shown in the figure) made of stainless steel etc., having an external diameter of about 8 mm with a covering of semi-conductive rubber (not shown in the figure) having a thickness of 5 mm, and hardness of about 20° to 70° (Asker hardness C). The rubber is in the solid state or in the foam sponge state with a volume resistivity of about $10^5$ to $10^9$ $\Omega\cdot$cm and the material is a rubber material such as polyurethane, EPDM, silicone, etc., in which conductive filler such as carbon has been dispersed or which contains an ionic conductive material.

The secondary image transfer roller 5A is formed, for example, by coating peripheral surface of a conductive metal core (not shown in the figure) made of stainless steel etc., having an external diameter of about 8 mm with a covering of semi-conductive rubber (not shown in the figure) having a thickness of 5 mm, rubber hardness of about 20° to 70° (Asker-C). The rubber is in the solid state or the foam sponge state with a volume resistivity of about $10^5$ to $10^9$ $\Omega\cdot$cm and the material is a rubber material such as polyurethane, EPDM, silicone, etc., in which conductive filler such as carbon has been dispersed or which contains an ionic conductive material.

Unlike the primary image transfer rollers 5Y, 5M, 5C, and 5K, since the secondary image transfer roller 5A comes into contact with the toner, it is common to use, on its surface, a coating of semi-conductive fluorine-based resin or urethane resin, etc., that have superior mold separation characteristics. The secondary image transfer backup roller 74 is formed, for example, by the coating peripheral surface of a conductive metal core (not shown in the figure) made of stainless steel etc., with a covering of semi-conductive material (not shown in the figure) of a rubber such as polyurethane, EPDM, silicone or a resin, etc., in which conductive filler such as carbon has been dispersed or which contains an ionic conductive material and the thickness of the material is in the range of 0.05 mm to 0.5 mm.

Next, the image forming process is described based on FIG. 2.

When the image recording is started, the drive motor (not shown in the figure) of the photoreceptor 1Y starts so that the photoreceptor 1Y of the yellow color (Y) image forming section 10Y is rotated in the counter-clockwise direction as shown by the arrow, and at the same time the electric potential of the photoreceptor 1Y starts to increase due to the charging action of the charging section 2Y.

After the charging of the photoreceptor 1Y is completed, writing of the image of the first color is started due to the electrical signal corresponding to the image data of Y, by the exposure device 3Y and a static electricity latent image of the Y image part of the document image is formed on the surface of the photoreceptor 1Y.

Said electrostatic latent image is reversely developed by the developing roller 4Y1, either in the contacting or in the non-contacting state, and the yellow (Y) toner image is formed on the photoreceptor 1Y along with the rotation of the photoreceptor 1Y.

The toner image formed on the photoreceptor 1Y during the above image forming process is transferred onto the intermediate image transfer belt 70 by the primary image transfer roller 5Y.

Subsequently, in synchronization with the toner image of Y on the intermediate image transfer belt 70, the toner images of magenta (M), cyan (C), and black (K) are formed successively superimposing on the previously formed color image thereby creating the color toner image.

After the image has been transferred, the toner remaining after transfer on the peripheral surfaces of the photoreceptors 1Y, 1M, 1C, and 1K are removed by the cleaning device 6Y, 6M, 6C, and 6K.

In synchronization with the formation of the color toner image on the intermediate image transfer belt 70, a recording sheet P which is separated and transported one sheet at a time is taken and transported via the registration roller 23 and the color toner image on the intermediate image transfer belt 70 is transferred at one time onto the recording sheet P by the secondary image transfer roller 5A.

The electrostatic charge on the recording sheet P onto which the color toner image has been transferred is discharged by the separation device (not shown in the figure), and the sheet is transported to the fixing device 24, and after the toner has been fixed, the sheet is ejected to the ejected sheet tray 26 by the sheet ejection rollers 25.

On the other hand, the toner remaining on the peripheral surface of the intermediate image transfer belt 70 after the image transfer has been completed is removed by the cleaning device 60.

The following describes the test of measuring the amount of toner stored in the space S by changing the system speed and the peripheral speed ratio of the toner guide roller 608 with respect to the intermediate image transfer belt 70, using the image forming apparatus of FIG. 2 provided with the cleaning device of FIG. 1.

(1) Test Conditions

Toner Guide Roller 608
Material: NBR
Hardness: 30 degrees in Asker C
Roller diameter: 16.2 mm
Drive source: special-purpose motor
Toner
6.5 μm polymerized toner
Toner Ejection Regulating Member 609
Material: PET
Plate thickness: 0.05 mm
Free length: 9 mm
Depth of cut: 5 mm pitch
Contact force: 0.014 N/cm
Intermediate Image Transfer Belt 70
Material: PI
Thickness: 75 μm
Cleaning Blade 602
Material: urethane rubber
Hardness: 75 degrees (JIS A rubber hardness)
Thickness: 2 mm
Free length: 9 mm
Blade load: 23 g/cm
Capacity of Space S: 11,000 $mm^3$ (2) Test Result See Table 1.

TABLE 1

| | R | | | | | | | | | | | | | | | |
|---|---|---|---|---|---|---|---|---|---|---|---|---|---|---|---|---|
| S · S | 0.3 | 0.4 | 0.5 | 0.6 | 0.7 | 0.8 | 0.9 | 1.0 | 1.1 | 1.2 | 1.3 | 1.4 | 1.5 | 1.6 | 1.7 | 1.8 |
| 200 | | | | | | | | C | B | A | A | A | A | A | B | C |
| 300 | | | | C | B | A | A | A | A | B | C | | | | | |
| 400 | | C | B | A | A | A | B | C | | | | | | | | |
| 500 | C | B | A | A | B | C | | | | | | | | | | |
| 600 | C | A | A | B | C | | | | | | | | | | | |

In Table 1, S·S indicates the system speed (mm/sec), and R denotes the peripheral speed ratio of the toner guide roller 608 with respect to the intermediate image transfer belt 70.

In the case of "A", there is no problem because the space S has an appropriate capacity. In the case of "B", however, the space S has a slightly excessive or insufficient capacity, and problems may arise, for example, in the environment of low temperature and low humidity wherein the toner is less condensable. In the case of "C", the space S has a considerably excessive or insufficient capacity, and problems are more likely to arise.

In the case of "C" wherein the peripheral speed ratio is smaller, the amount of the remaining toner discharged from the space S is reduced and the stored amount is increased. This is more likely to cause packing of the remaining toner or slipping of toner from the cleaning blade.

In the cased of "C" wherein the peripheral speed ratio is greater, the amount of the remaining toner discharged from the space S is increased and the stored amount is reduced. This is more likely to cause increased wear of the cleaning blade or filming.

Table 2 summarizes the peripheral speed ratios evaluated as in the category of "A" in Table 1.

TABLE 2

| | S · S | | | | |
|---|---|---|---|---|---|
| | 200 | 300 | 400 | 500 | 600 |
| R | 1.2-1.6 | 0.8-1.1 | 0.6-0.8 | 0.5-0.6 | 0.4-0.5 |

Thus, the peripheral speed ratio is preferably increased when the system speed is lower, and the peripheral speed ratio is preferably decreased when the system speed is higher.

Table 3 shows the result of replacing the peripheral speed ratio of Table 2 by the peripheral speed of the toner guide roller 608.

TABLE 3

| | S · S | | | | |
|---|---|---|---|---|---|
| | 200 | 300 | 400 | 500 | 600 |
| 608 | 240-320 | 240-330 | 240-320 | 250-300 | 240-300 |

In Table 3, reference numeral 608 denotes the peripheral speed (mm/sec) of the toner guide roller 608.

Table 3 suggests that, despite a change in the system speed, the peripheral speed of the toner guide roller 608 is preferably kept at an approximately constant level. To be more specific, if the peripheral speed of the toner guide roller 608 is set at a value from 250 through 300 mm/sec, it can fluctuate within this range or can be kept at a constant level.

It should be noted that these test results are not only determined by the aforementioned test conditions. To be more specific, the data of the test results changes with a change in the test conditions, but the data exhibits similar tendencies.

Figure 3:
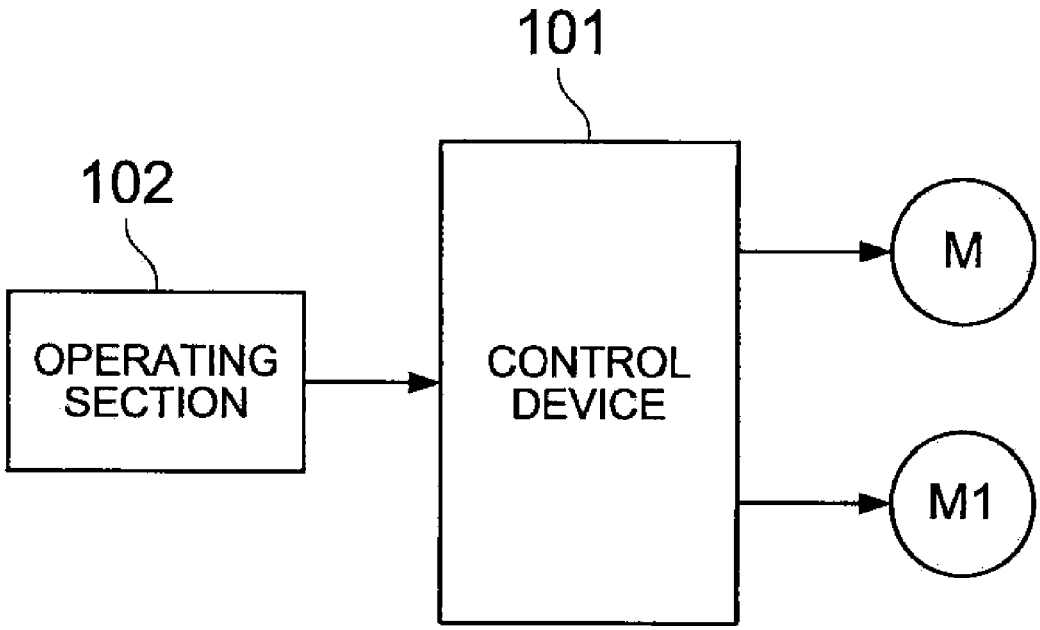
FIG. 3 is a block diagram of the present invention.

The structure of the present invention is shown in the block diagram of FIG. 3.

When supply of thick paper is set using the operation section 102, the control device 101 reduces the speed of the motor M so that the system speed is reduced. It should be noted that the motor M does not mean a peculiar motor, but refers to all the motors related to system speed including the motors of a sheet feeding roller, intermediate image transfer belt and photoreceptor drum. At the same time, the control device 101 controls the motor M1 that independently drives the toner guide roller 608, and changes the peripheral speed ratio of the toner guide roller 608 with respect to the intermediate image transfer belt 70, i.e., the peripheral speed ratio of the toner guide roller 608 with respect to the speed of the system.

To put it more specifically, the peripheral speed ratio is increased when the system speed has been reduced, and the peripheral speed ratio is reduced when the system speed has been increased, as shown in Table 2.

As shown in Table 3, despite a change in the system speed, the peripheral speed of the toner guide roller 608 can be set at a level within a predetermined range.

Further, as for the aforementioned structure of the cleaning device, a roller made of rubber or resin can be used as the toner guide roller.

The toner ejection regulating member can be made of a thin metal plate wherein a spring is used to supply bias.

Further, the present invention relates to a cleaning device for removing the toner remaining on the image carrier, without being restricted to the intermediate image transfer belt. It can be a cleaning device that removes the toner remaining on the photoreceptor drum.

The image forming apparatus of the present invention is capable of keeping the amount of the remaining toner stored in the space at a constant level, thereby supplying the remaining toner adequately to the cleaning blade and prolonging the service life of the cleaning blade.

What is claimed is:

1. An image forming apparatus comprising:

an image carrier which is rotated to carry a toner; and a cleaning device including:

a cleaning blade in contact with the image carrier with contact pressure for removing the toner remaining on the image carrier;

a toner guide roller which is located upstream of the cleaning blade in a rotating direction of the image carrier and which rotates in contact with the image carrier; and a toner ejection regulating member in contact with the toner guide roller to eject the remaining toner appropriately from a space which stores the remaining toner, the image forming apparatus further comprising, a control device which controls the cleaning device so as to change a peripheral speed ratio of the toner guide roller with respect to the image carrier, in response to change in a system speed, wherein the space is formed by enclosure of the image carrier, the cleaning blade, the toner guide roller and the toner ejection regulating member.

2. The image forming apparatus of claim 1, wherein when the system speed is reduced, the control device increases the peripheral speed ratio and when the system speed is increased, reduces the peripheral speed ratio.

3. The image forming apparatus of claim 1, wherein the control device sets the peripheral speed ratio in response to the change in the system speed so as to keep a peripheral speed of the toner guide roller within a prescribed range regardless of the change in the system speed.

* * * * *